United States Patent [19]

Christie

[11] Patent Number: 4,553,246

[45] Date of Patent: Nov. 12, 1985

[54] CONSTRUCTION METHOD AND APPARATUS FOR INSTALLING A HANGER-SUPPORTED HEATING ELEMENT IN AN ELECTRICAL RESISTANCE FURNACE

[76] Inventor: C. T. Christie, P.O. Box 54, Scio, Oreg. 97374

[21] Appl. No.: 542,734

[22] Filed: Oct. 17, 1983

[51] Int. Cl.[4] ..... H05B 3/66

[52] U.S. Cl. ..... 373/130; 373/137

[58] Field of Search ..... 219/280, 283, 284, 315, 219/316, 355, 408, 542, 546; 338/280, 283, 284; 373/119, 128, 130, 134, 137

[56] References Cited

U.S. PATENT DOCUMENTS

| | | | |
|---|---|---|---|
| 1,861,947 | 6/1932 | Woodson et al. | 373/130 |
| 1,878,619 | 9/1932 | Bechtel | 373/128 |
| 1,947,612 | 2/1934 | Moore | 373/130 |
| 2,035,306 | 3/1936 | Fannin | 373/130 |
| 3,812,276 | 5/1974 | Cyrway et al. | 373/128 |
| 4,088,825 | 5/1978 | Carr | 373/130 |
| 4,154,975 | 5/1979 | Sauder | 373/130 |
| 4,259,538 | 3/1981 | Jones | 373/137 |
| 4,346,252 | 8/1982 | Walton et al. | 373/137 |
| 4,418,415 | 11/1983 | Raymond | 373/137 |
| 4,429,403 | 1/1984 | Hooper | 373/128 |

FOREIGN PATENT DOCUMENTS

| | | | |
|---|---|---|---|
| 2404819 | 6/1979 | France | 373/130 |
| 1433744 | 4/1976 | United Kingdom . | |

*Primary Examiner*—A. D. Pellinen
*Assistant Examiner*—Gregory D. Thompson
*Attorney, Agent, or Firm*—Chernoff, Vilhauer, McClung, Birdwell & Stenzel

[57] ABSTRACT

An apparatus and method for insulating an electric furnace having resistive heating elements in which precast support rings comprising studs, a ring and a plurality of rods are welded to a furnace wall alternatively with placing batts of ceramic fiber insulation over the support rings against the furnace wall to form an inner insulated furnace wall. The rods have rotatably mounted removable ceramic hangers having an inner hook for supporting a serpentine electric heating element such that there is no danger of a short circuit with the metal support ring if the hanger fails.

14 Claims, 6 Drawing Figures

CONSTRUCTION METHOD AND APPARATUS FOR INSTALLING A HANGER-SUPPORTED HEATING ELEMENT IN AN ELECTRICAL RESISTANCE FURNACE

BACKGROUND OF THE INVENTION

The following invention relates to a method and apparatus for installing lightweight ceramic fiber insulation and for supporting electric resistance heating elements in an electric furnace.

Furnaces utilizing electrical resistance heating elements are well known in the art. Typically such furnaces include an outer steel wall of square or cylindrical construction having an inner insulating wall of fire brick or relatively rigid blocks of ceramic insulation. The heating elements for such furnaces typically include a plurality of electric resistance coils wound in a serpentine or sinusoidal fashion and supported from hangers or rods fixedly attached to the fire brick or outer steel wall. In practice it has been necessary with such furnaces to drill holes through the ceramic insulation or brick for the placement of the hangers. An example of such a furnace is shown in British Patent No. 1,433,744 to James H. Nock. In the Nock construction, hooked brackets are inserted through a plurality of insulating layers of material in the interior of a furnace which are affixed to hard refractory material at the outermost casing. The problem with this type of construction is that the bores for the brackets must be precisely placed in order that the separation between adjacent hangers will fit the dimensions of the serpentine heating elements. All bores must be alined within the same horizontal plane and the distance between any two of the bores must be precise so that the upper loops of the heating elements will come to rest on the hangers.

Other furnaces do not use hard refractory material as insulation, but, instead make use of modules of fiberous ceramic batts. The batts are stacked about the interior wall of the furnace contiguously until they form an interior insulating wall. Suitable adhesive, or in some cases, a weldable metallic stud is used on the back of each of the individual batts to secure them to the wall. Brackets for suspending the serpentine heating elements are typically imbedded within the batts. Two examples of this type of construction are shown in the U.S. Patents to Sauder U.S. Pat. Nos. 4,154,975 issued May 16, 1979 and to Carr 4,088,825 issued May 9, 1978. In the furnaces of the '825 and '975 patents, anchors for the support hooks which carry the heating elements are embedded within modules of ceramic fiber insulation. The problem with this type of construction is that in time the anchors will pull free of the insulation. Also, in both patents the heating elements are suspended from ceramic spools supported by a metal rod or hook. If the spool were to crack, the metal underneath would be exposed to the heating element, and heat would be supplied directly to the metal anchors in the interior of the insulation. This is undesireable because it prematurely weakens the insulation covering the anchor, allowing the anchor to pull free.

SUMMARY OF THE INVENTION

The present invention overcomes these and other difficulties by providing a preformed support ring which acts as a support for both the electric heating elements and the modules of insulating material. Such material may be in the form of ceramic fiber bales or batts which are relatively lightweight, although heavier types of insulation may also be used. The term "ring" is intended herein to include geometries other than circular since some furnaces are square or rectangular. The support ring may be of single-piece construction or may be constructed in arcs or sections, where each section includes at least one supporting stud for attachment to the outer wall of the furnace, and also includes a plurality of interiorly disposed rods. The rods preferably have an interior hook portion extending upwardly for holding ceramic hangers. The ceramic hangers generally take the form of cylinders having a hollow channel or bore and an upwardly extending hook portion affixed to the outside of the cylinder. The hangers are adapted to fit over the upwardly extending portions of the rods. The rods are generally cylindrical and the diameter of the hollow channel portion of the hanger elements is slightly greater than the diameter of the rods. This enables a limited degree of freedom of movement for the hook portion of the hanger elements, which might be necessary if the heating element is warped or bent. The rods are welded to the ring with a predetermined spacing between each which is an integral multiple of the distance between adjacent loops of the serpentine heating elements. The vertical cross-sectional dimension of the ring is arranged to be greater than that of the individual rods, thus providing upwardly and downwardly extending lips or flanges. These lips engages grooves which may be cut into each module or section of insulative material thus holding them in place, and permitting the lower surface of the insulating material to rest directly on top of the rods.

The furnace is insulated by installing alternately a support ring and rows of insulative material, one on top of the other, until an interior wall is formed. It is preferable to construct circular rings, for installation in a cylindrical furnace, in semicircular sections. Thus, only two sections must be horizontally aligned to form a complete ring.

Provision is also made for retraining warped or bent heater elements. The hangers have top and bottom grooves which may conveniently allow an installer to tie down warped sections. When the element heats up, the restraining force of the tied junction will retrain the element to the proper configuration.

It is an object of this invention to provide a means of supporting a serpentine heating element in an electric furnace without the necessity of precisely placed bores in the furnace wall for hangers.

It is another object of this invention to provide electrically insulative hangers for supporting an electric resistance heating element without the danger of creating an electrical hazard in the event that the hanger cracks or breaks.

A further object of this invention is to provide a method of insulating an electric resistance furnace in an expedient manner without having to drill bores through previously installed insulation or firebrick.

A still further object of this invention is in the providing of hangers that are prearranged to fit the tolerances of an electric resistance heating element while providing a limited degree of freedom for those hangers should tolerances vary or should the heating elements become warped.

Yet a further object of this invention is the providing of preconstructed sections of apparatus for supporting insulation and heating elements which can be quickly installed at the furnace site.

A still further object of this invention is in the providing of a method for installing fibrous insulation in an electric furnace without the necessity of mechanically attaching the insulation to the furnace wall.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 6:
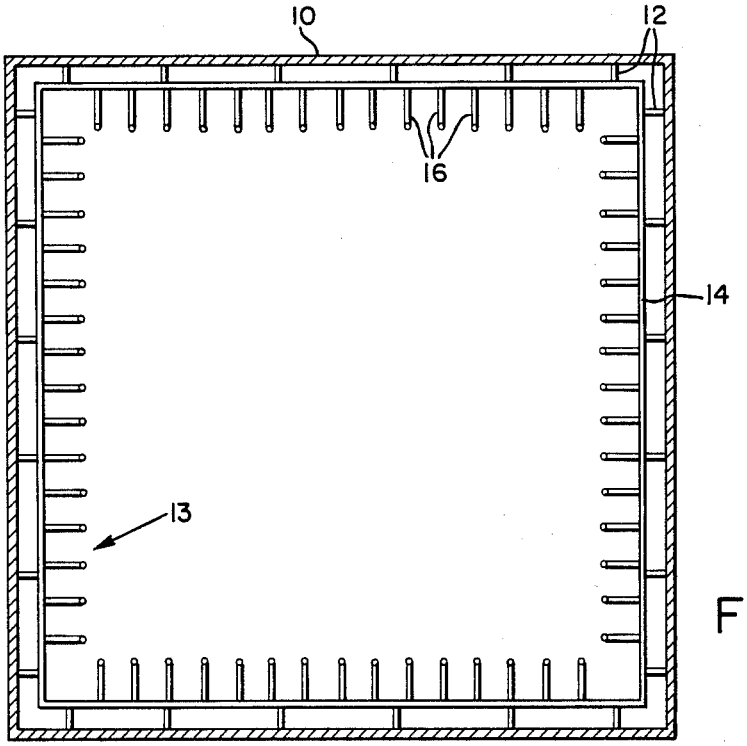
FIG. 6 is a plan view of the ring of the invention mounted in a square furnace.

Referring generally to the drawings, an electrical furnace has an outer wall 10 which is usually constructed of steel. Permanently affixed to the wall by support studs 12 is a ring 14. The ring 14 may have a variety of geometric configurations depending upon the geometry of the interior of the furnace. For example, in FIG. 6 the furnace is of square cross-section and, hence, the ring 14 is square.

Figure 3:
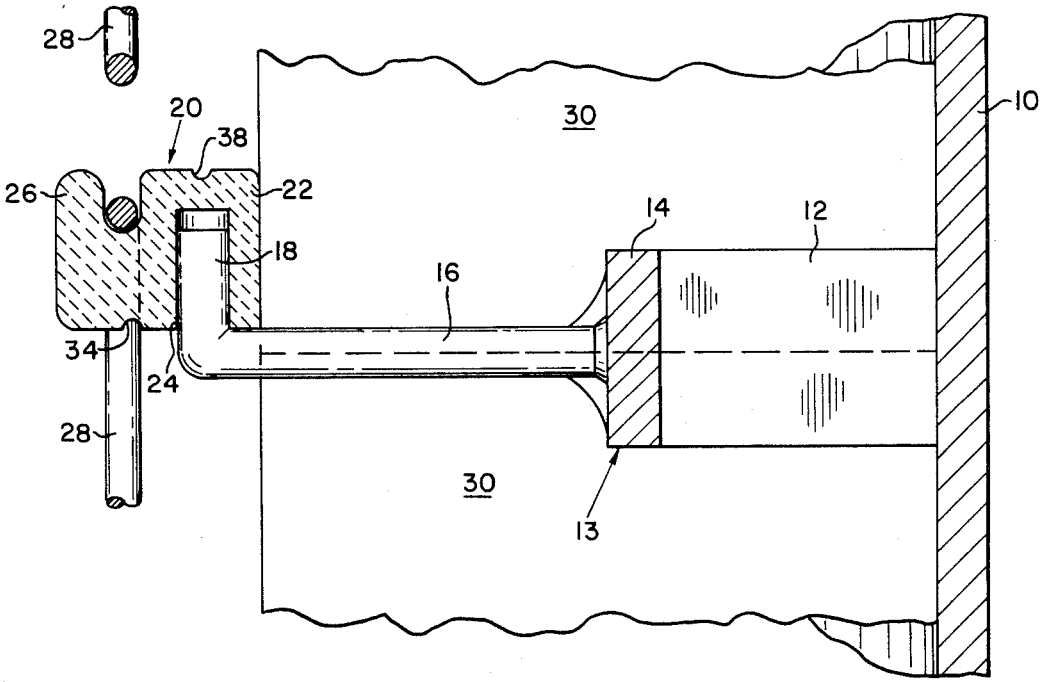
FIG. 3 is a partial cut-away side view taken along line 3—3 of FIG. 1.
Figure 5:
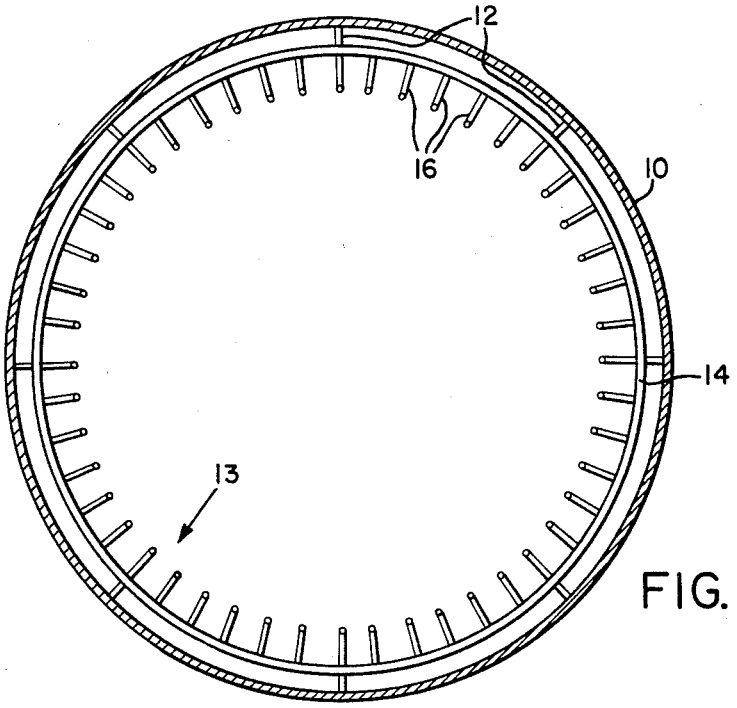
FIG. 5 is a plan view of the ring of the invention mounted in a cylindrical furnace.

The ring has a series of rods 16 permanently affixed thereto and each rod has an upwardly extending portion 18 at its radially innermost end. Viewed in cross-section, as shown in FIG. 3, the ring has a vertical dimension which is larger than the cross-sectional vertical dimension of the rod. This allows the rods 16 to be attached to the ring 14 at approximately its midpoint in vertical cross-section so as to create a ridge or tongue extending both above and below rods 16. The combination of a ring 14, studs 12 and rods 16 will hereinafter be referred to as a support ring 13.

Mounted on the upwardly extending portion 18 of each rod 16 is a ceramic hanger 20. Each ceramic hanger has a cylindrical portion 22 with a generally coaxial cylindrical channel 24 extending vertically from its bottom surface. The hanger also has a hooked portion 26 suitable for supporting a serpentine heating element 28.

Bales or batts of ceramic fiber insulation 30 are placed on top of each support ring 13 in contiguous fashion about the periphery of the furnace wall. The insulation is cut with a notch or groove 32 so as to fit over this ridge, and the lower surface of the insulation then rests directly on top of rods 16. When laid on top of the ring in this manner the batts form a vertical slice of an inner insulated wall portion for the furnace. The batts are held in place by the cooperation of the groove 32 with the ridge or tongue in support ring 13.

Figure 1:
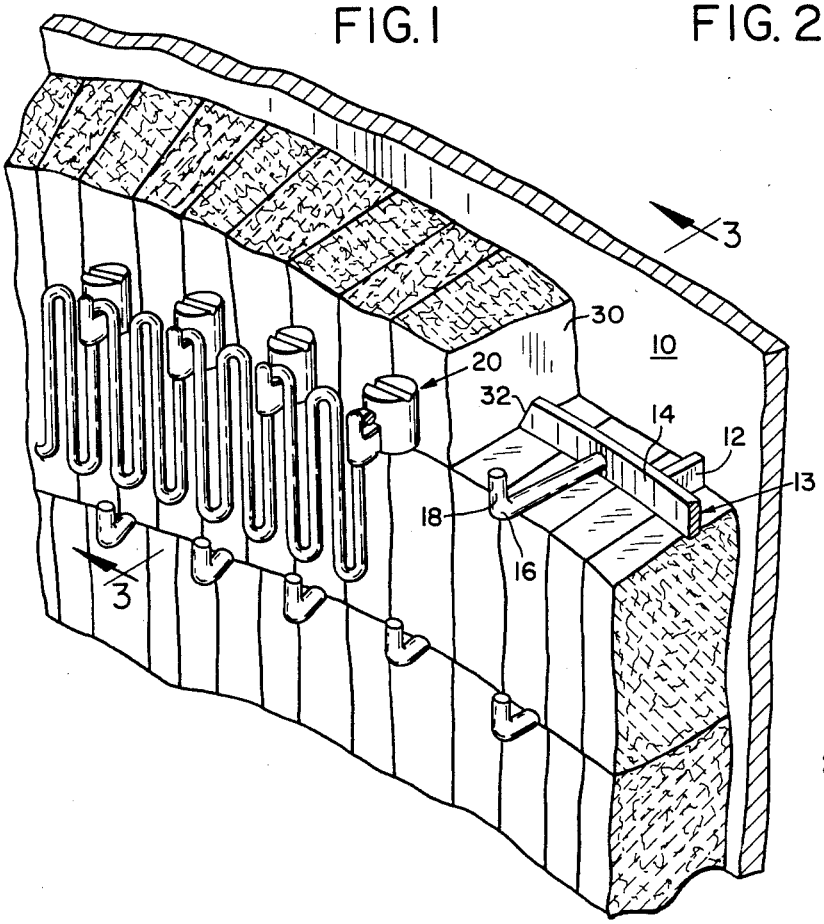
FIG. 1 is a partial cut-away perspective view of a portion of an electrical furnace constructed in accordance with the invention.
Figure 2:
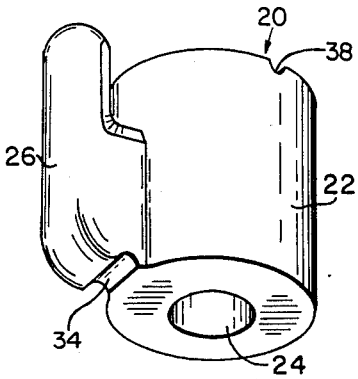
FIG. 2 is a perspective view of a ceramic hanger which forms a part of the invention.
Figure 4:
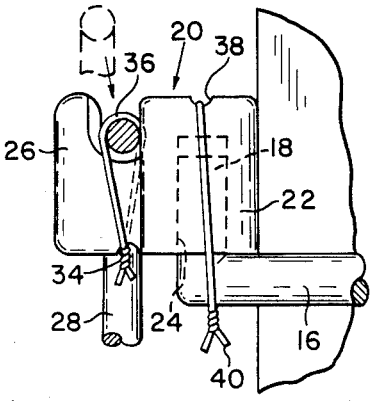
FIG. 4 is a partially cut-away side view of a rod and hanger with a heating element tied thereto for retraining.

Another aspect of the invention lies in the provision made in the hangers 20 for the retraining of bent or warped heating elements 28. In FIG. 4 the heating elements are shown tied down to hangers 20. To facilitate such tying, a groove 34 is made in the lower surface of the hook portion 26, and a wire 36 may then be used to tie a loop of the heating element 28 to each portion. Similarly to restrict freedom of movement of the hanger 20, a wire 40 is tied through an upper groove 38 in the cylindrical portion 22 of hanger 20. If tied down in this manner, the heater element, when heated, will resume its original shape.

In order to insulate the interior of an electric furnace, the support rings 13 with hangers 20 are alternated with layers of insulation so that the interior of the furnace is insulated one vertical slice at a time. Each support ring 13 is constructed prior to installation in sections or arcs. Such sections of the rings 14, the studs 12, and the rods 16 are precast and welded together at some location remote from the installation site.

As mentioned above, the rings are precast and the studs and rods are preferably welded to the sections of each ring. The rods 16 are welded to the ring sections such that there is a predetermined distance between each pair of rods in a completed ring. In order to fit the loops of the serpentine heating elements 28, this distance must always be an integral multiple of the distance between any two adjacent upper loops. In this way the hook portion 26 of the hangers 20 mounted on the upwardly-extending end portions 18 of the rods generally fit the upper looped portions of the serpentine heating elements 28.

However, in order that slight variations in tolerances may be accommodated, the hanger elements 20 are adpated for rotatable movement on the upwardly extending portions 18 of rods 16. This freedom of movement is insured by having the diameter of the channels 24 slightly larger than the diameter of the upwardly extending portions 18.

The preferred method of insulating the furnace is to stack insulation on top of a support ring 13, one vertical slice at a time, beginning with the bottom of the furnace. Typically, a support ring 13 is mounted to the wall 10 in which the sections of the support ring are arranged to fall within the same general horizontal plane. This plane is normal to the walls of the furnace 10. Next, a notch or groove 32 is made in each block or bale of insulation 30. These grooves are aligned with the upwardly-extending ridge formed by the vertical portion of the ring 14 that extends past the vertical cross-sectional dimension of the rods 16. Once insulation has been laid contiguously about the periphery of the furnace wall 10 in this manner, a vertical slice of an inner insulated wall of the furnace has been constructed, and another support ring may be constructed on top of this vertical slice. Preferably, insulation is also grooved at its upper end so as to accommodate the lower extending ridge or tongue formed by the ring. Both upper and lower grooves in the insulation are cut at a thickness which is approximately equal to the length of the studs 12, so as to mate with the ring 14.

For the case of a cylindrical furnace, precast and prewelded sections of the support rings 13 are delivered to the furnace site as completed semicircles. The preferred method of attaching the semicircles to the steel walls 10 of the furnace to form a completed ring is by welding the outer ends of studs 12 to the outer wall of the furnace 10 and then welding the two semicircular sections together.

To install the serpentine heating elements 28, it is first necessary to place the hangers 20 over the upwardly-extending ends 18 of the rods 16. The hangers 20 are rotated until the hook portions 26 are inwardly directed and loops of the heating elements are then hung from the hook portions 26. There is one such heating element for each vertical slice of the furnace.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In an electric furnace having at least one outer wall the combination comprising:

(a) heat insulating material formed of a plurality of compressed fiberous batts arranged contiguously along the periphery of said wall so as to form a vertical slice of an inner wall, wherein each of said batts has a notch in a lower surface thereof such that when said batts are contiguously arranged said notchs align to form a continuous groove; and (b) a support ring affixed to said outer wall and spaced inwardly of said outer wall by a distance sufficient to engage said groove.

2. Apparatus for installing insulation in an electric furnace having a heating element comprising:

(a) a support ring affixed to a wall of said furnace and spaced inwardly of said wall said support ring having a plurality of rods mounted thereon at a vertical distance below the top of said ring thereby forming a vertical ridge;

(b) heat insulating material being placed adjacent said wall and on top of said ring, said material having a groove in at least one surface thereof mating with said ridge and said material forming at least a vertical slice of an inner wall of said furnace when placed contiguously about the periphery of said wall; and (c) electrically insulative means mounted to said rods supporting said heating element.

3. The apparatus of claim 2 wherein said heat insulating material comprises a plurality of compressed fibrous batts.

4. The apparatus of claim 2 wherein said rods have a predetermined spacing therebetween and wherein said heating element has a serpentine configuration such that the predetermined spacing between the rods substantially conforms to an integral multiple of the spacing between adjacent loops of the heating element.

5. The apparatus of claim 4 wherein said electrically insulative means includes a hanger portion spaced inwardly of the innermost ends of said rods.

6. The apparatus of claim 5 wherein each of said electrically insulative means includes a vertical axis and each of said insulative means are mounted on the innermost ends of said rods for rotatable movement about said axis.

7. A method of installing insulation having a predetermined thickness in an electric furnace, comprising the steps of:

(a) constructing portions of a ring, each portion having at least one outwardly extending stud of a predetermined length;

(b) fixedly mounting enough of said portions to an outer wall of said furnace to form a complete ring, the horizontal plane of said ring being normal to the walls of said furnace;

(c) cutting a groove in at least one surface of said insulation at a fraction of its predetermined thickness, said fraction substantially corresponding to the predetermined length of said studs, and aligning said groove with said ring;

(d) installing said insulation on top of said ring until a vertical slice of an inner wall has been formed with said insulation; and (e) repeating steps a-d until substantially the entire inner wall of said furnace has been formed with insulation.

8. The method of claim 7 further comprising forming on said ring portion of plurality of inwardly extending rods fixedly spaced at predetermined intervals along said ring portions and providing each of said rods with electrically insulative means supporting an electrical heating element.

9. In an electrical resistance furnace having an outer wall and including fibrous heat insulating material arranged about the periphery of said outer wall, the combination comprising:

(a) support ring means holding said fibrous heat insulating material in stacked vertical slices along said wall, said means including a plurality of rods having vertically extending end portions;

(b) a plurality of electrically insulative hanger elements mounted on the end portions of said rods, said hanger elements including vertically oriented hook portions disposed radially inwardly of the end portions of said rods; and (c) an electrical resistance heating element mounted on said hook portions of said hanger elements.

10. The combination of claim 9 wherein said hanger elements are rotatably movable about the respective vertical end portions of said rods.

11. The combination of claim 9 wherein said support ring means includes a vertically extending flange which mates with a vertical groove in said fibrous heat insulating material.

12. An electrically insulative heat resistant hanger suspending an electric heating element in an electric furnace, comprising a first hanger portion rotationally mounted about a vertical axis on a vertically extending end portion of a supporting rod and a second hanger portion including a hook supporting at least part of said electric heating element.

13. The electrically insulative heat resistant hanger of claim 12 wherein said hanger is constructed of ceramic material.

14. The electrically insulative heat resistance hanger of claim 12 wherein the supporting rod extends radially inwardly from a wall of the furnace and the second hanger portion is disposed radially inwardly from the radially innermost end of the supporting rod.

* * * * *